US005380111A

United States Patent [19]

Westrom

[11] Patent Number: 5,380,111

[45] Date of Patent: Jan. 10, 1995

[54] RELEASABLE SPACER ASSEMBLY FOR BINDERS

[76] Inventor: S. John Westrom, 25 NW. 44th Ave., Des Moines, Iowa 50313

[21] Appl. No.: 170,147

[22] Filed: Dec. 20, 1993

[51] Int. Cl.[6] ..... B42F 13/00

[52] U.S. Cl. ..... 402/74; 402/80 R; 402/502

[58] Field of Search ..... 402/73, 74, 78, 80 R, 402/80 P, 502, 2; 281/20

[56] References Cited

U.S. PATENT DOCUMENTS

| | | | |
|---|---|---|---|
| 501,751 | 7/1893 | Waring | 402/73 |
| 3,220,078 | 11/1965 | Preziosi | 402/80 P |
| 3,784,232 | 1/1974 | Greene | 402/2 |
| 3,822,099 | 7/1974 | Angle | 402/80 R |
| 4,524,991 | 6/1985 | Thomas . | |
| 4,531,764 | 7/1985 | Chang | 402/80 P |
| 4,997,207 | 3/1991 | Feldman | 402/73 |
| 5,002,416 | 3/1991 | Serzen | 402/74 |
| 5,267,804 | 12/1993 | Baumgarten | 402/73 |

*Primary Examiner*—Richard K. Seidel
*Assistant Examiner*—Hwei-Siu Payer
*Attorney, Agent, or Firm*—Brian J. Laurenzo; Kent A. Herink; Brett J. Trout

[57] ABSTRACT

A releaseable spacer assembly for the cover members of a binder for holding paper and the like, the releaseable spacer assembly allowing for the spacing of the cover members in a substantially parallel relationship for even stacking and standing of several binders while maintaining the cover members in a closed position when the releasable spacer assembly is in place. The releaseable spacer assembly comprises a longitudinal spacer member which is releasably attached independently to the inside of both of the cover members of the binder.

17 Claims, 4 Drawing Sheets

RELEASABLE SPACER ASSEMBLY FOR BINDERS

BACKGROUND OF THE INVENTION

This invention relates to binders for holding paper and the like and, more particularly, to releasable spacing means for the covers of a binder in which the covers may be spaced in a substantially parallel relationship for stacking and standing of several binders while maintaining the covers in a closed position.

Binders for holding loose leaf paper and the like are well known in the art. Such binders generally comprise a first front cover and a second back cover, both of which are hingedly attached to a common spine. Paper retention means such as the well-known two and three rings which may be opened and closed to receive paper are generally affixed to the spine between the front and back covers.

The storing of such binders is problematic. This is because when a binder is less than full of paper or the like, as is often the case, the edges of the covers opposite the spine tend to converge toward each other making stacking and other storage systems where it is desired to place several binders in a substantially parallel relationship awkward. Standing such binders in an upright orientation next to one another on a shelf or on their spines in a filing drawer is likewise difficult as the binders collapse into closed positions in which the covers are not substantially parallel. Even standing one binder alone on a shelf is difficult when the first and second cover members are not substantially parallel. Such binders also will not remain stacked flat in a pile as they tend to slide apart from each other.

A number of attempts have been made to provide stackable or standable binders. Boxes for receiving binders allowing for stacking and standing of binders are known but do not maintain the first and second covers of the binders closed in a substantially parallel relationship. U.S. Pat. No. 5,002,416 discloses a spacer for the covers of a binder. A spacing element having a base portion is affixed to the inside surface of one of the covers. When the binder is closed the transversely extending portion of the spacing element contacts the opposing cover thereby preventing the binder from fully closing. However, the spacer element shown in this patent does not disclose releasable spacing means nor means for maintaining the binder closed for storage or stacking.

The difficulties in the prior art are substantially eliminated by the present invention.

SUMMARY OF THE INVENTION

Accordingly, it is an object of the present invention to provide a releasable spacer assembly for binders in which the covers may be spaced in a substantially parallel relationship for even stacking and standing.

It is another object of the present invention to provide a releasable spacer assembly for binders which maintains the covers in a closed position.

It is still another object of the present invention to provide a releasable spacer assembly for binders which is releasably attached to both covers of such binders.

It is a further object of the present invention to provide a releasable spacer assembly for binders which can be removed from one cover while remaining attached to the other cover.

It is an additional object of the present invention to provide a releasable spacer assembly for binders which allows such binders to stand on any of their top, bottom or sides without collapse.

By the present invention, it is proposed to overcome the difficulties encountered heretofore. To this end, releasable spacing means for cover members of a binder are provided, the releasable spacing means allowing for the spacing of the cover members in a substantially parallel relationship for even stacking and standing of several binders while maintaining the cover members in a closed position when the releasable spacing means are in place. The releasable spacing means comprise first cover securement means located on and attached to the first cover member of the binder, second cover securement means located on and attached to the second cover member of the binder, and a longitudinal spacer member having a first end and a second end for location between the first and second cover securement means, the spacer member further comprising first spacer securement means located on and integral with the first end of the spacer member for releasable attachment to the first cover securement means and second spacer securement means located on and integral with the second end of the spacer member for releasable attachment to the second cover securement means.

BRIEF DESCRIPTION OF THE DRAWING

FIGS. 5*a*–5*d* are views taken along lines 5—5 of FIG. 4 which show the various positions of the first spacer securement means as the longitudinal spacer member is rotated while

DETAILED DESCRIPTION OF THE INVENTION

Figure 1:
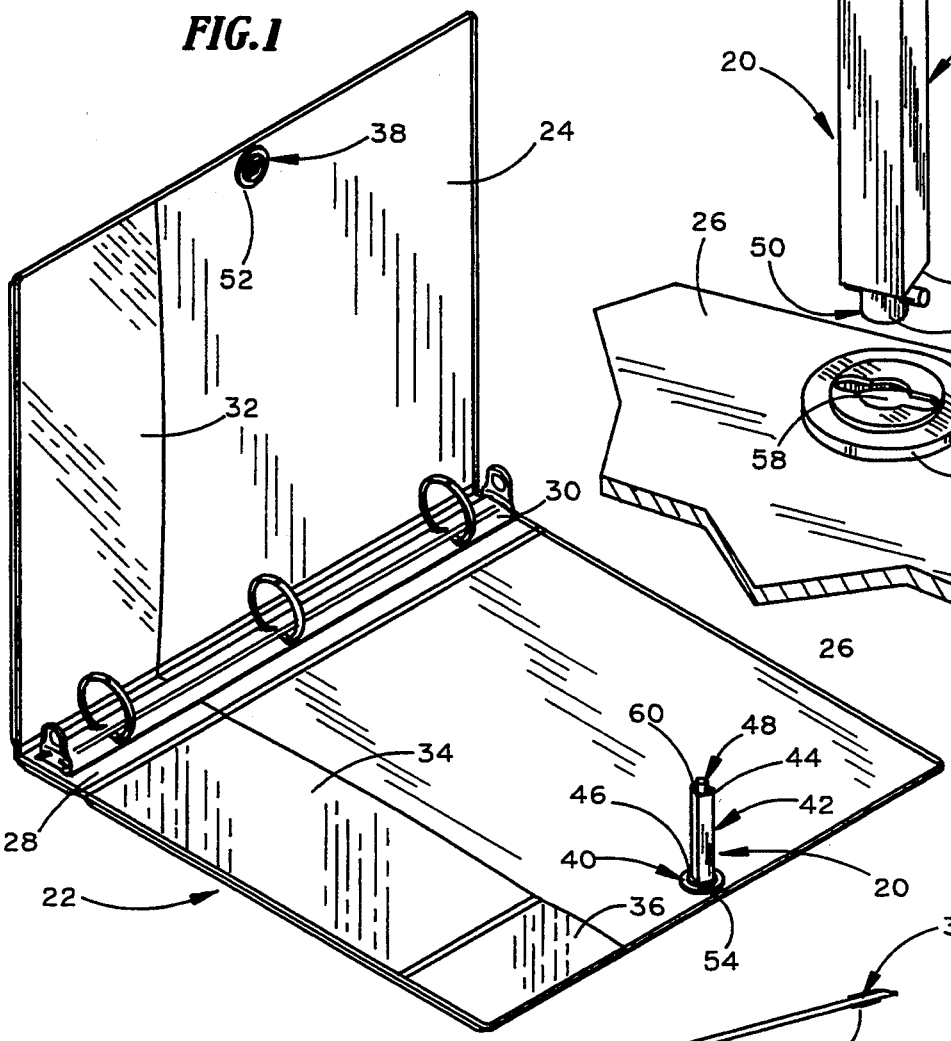
FIG. 1 is a perspective view of a binder showing the releasable spacing means of the preferred embodiment of the present invention.
Figure 2:
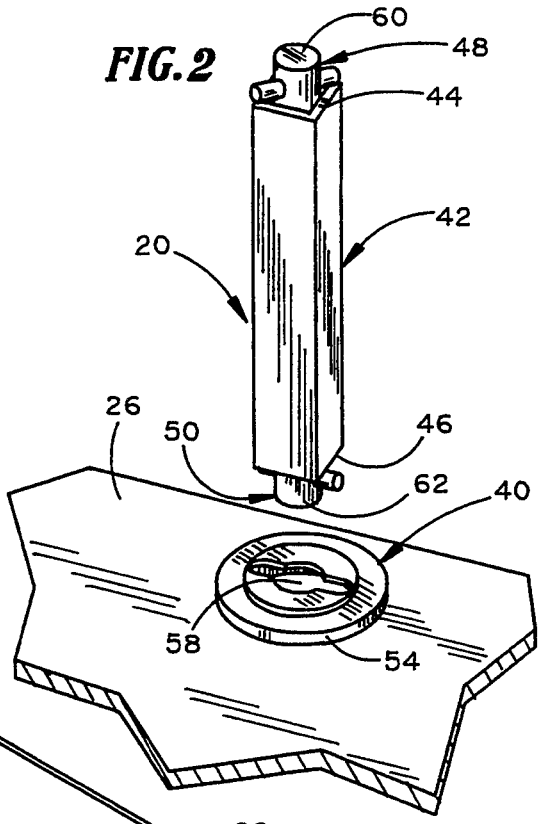
FIG. 2 is an enlarged perspective view of a portion of the releasable spacing means particularly showing a longitudinal spacer member, cover securement means and spacer securement means as also shown in FIG. 1.
Figure 3:
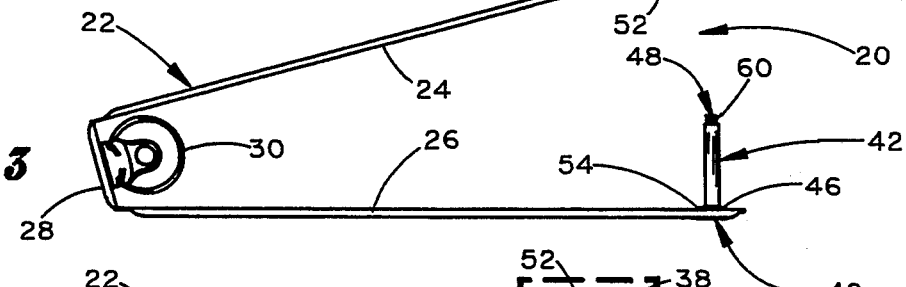
FIG. 3 is an elevational view of the binder and releasable spacing means of FIG. 1 in a somewhat closed position.

In the Figures, releaseable spacing means are shown generally at 20 for a binder 22, the releaseable spacing means 20 allowing for the spacing of a first cover member 24 and a second cover member 26 in a substantially parallel relationship for even stacking and standing of the binder 22 with other binders while maintaining the first and second cover members 24 and 26 in a closed position when the releasable spacing means 20 are in place.

In FIGS. 1–6, the preferred embodiment of the releasable spacing means 20 for the binder 22 are shown. The binder 22 comprises the first cover member 24, the second cover member 26 and a common spine member 28 to which both the first cover member 24 and the second cover member 26 are hingedly attached. Such binders 22 are well known in the art. A three-ring loose leaf fastening system 30 is shown affixed to the spine member 28. Such fastening systems 32 and means for affixation are well known in the art. Also shown are pockets 32 and 34 on the first cover member 24 and cover member 26 respectively for alternative retention of paper and the like, as well as a pocket 36 for file identification indicia, the advantage of which will be described hereinafter. The binder 22 is shown in what will be referred to as an open position in FIG. 1 and what will be referred to as a closed position in FIG. 4.

The releasable spacing means 20 of the present invention comprise first cover securement means 38 located on and attached to the first cover member 24 of the binder 22, second cover securement means 40 located on and attached to the second cover member 26 of the binder 22 and a longitudinal spacer member 42 for location between the first cover securement means 38 and the second cover securement means 40. The first and second cover securement means 38 and 40 may be attached to the first and second cover members 24 and 26, respectively, in a variety of ways, all of which are known in the art. The depth of the cover securement means 38 and 40 can be designed to accommodate binders of varying thicknesses.

The spacer member 42 has a first end 44 and a second end 46 and includes first spacer securement means 48 located on and integral with the first end 44 of the spacer member 42 and second spacer securement means 50 located on and integral with the second end 46 of the spacer member 42. The first spacer securement means 48 are capable of mated alignment and releasable attachment to the first cover securement means 38 and the second securement means 50 are capable of mated alignment and releasable attachment to the second cover securement means 40. In the preferred embodiment, the mated alignment between the first spacer securement means 48 and the first cover securement means 38 is offset with respect to the mated alignment between the second spacer securement means 50 and the second cover securement means 40 as will be explained hereinafter.

Figure 4:
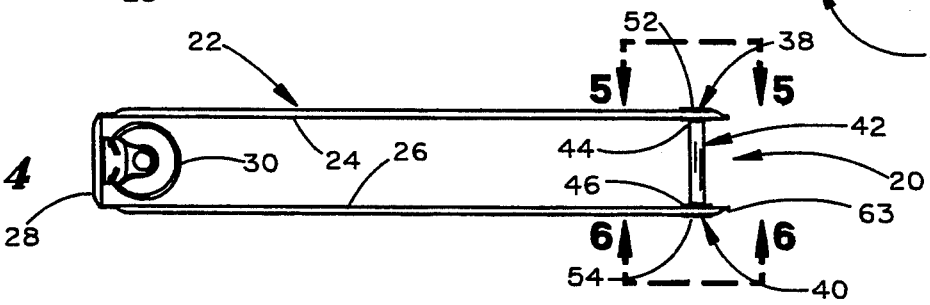
FIG. 4 is an elevational view of the binder and releasable spacing means of FIG. 1 in a closed position.
Figure 5A:
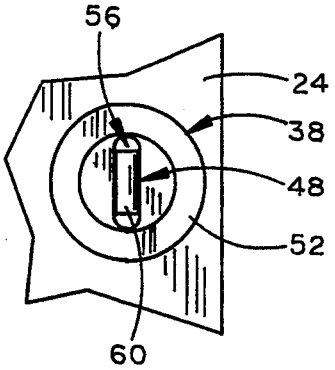
Figure 6A:
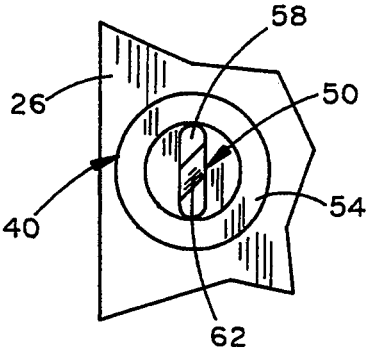
FIGS. 6*a*–*d* are views taken along lines 6—6 of FIG. 4 which show the relative positions of the second spacer securement means as the longitudinal spacer member is rotated.

The preferred embodiment of the releasable spacing means 20 includes identical first and second cover securement means 38 and 40 which comprise first and second slotted reinforcement members 52 and 54 respectively which are affixed to the first cover member 24 and the second cover member 26 of the binder 22 respectively. The first and second slotted reinforcement members 52 and 54 include identically configured slots 56 and 58 respectively which correspond in location to receive the longitudinal spacing member 42 therebetween when the first cover member 24 and the second cover member 26 are placed in the closed position as shown in FIG. 4. As will be explained hereinafter, the slots 56 and 58 may be oriented in an offset manner.

The longitudinal spacer member 42 of the preferred embodiment comprises a longitudinal four-sided member of a length which, when releasably secured between the first and second cover securement means 38 and 40, spaces the first and second cover members 24 and 26 in a substantially parallel relationship.

The first spacer securement means 48 and the second spacer securement means 50 of the preferred embodiment comprise identically configured key assemblies 60 and 62 which correspond in size and shape so as to be received in the slots 56 and 58 of the first cover securement means 38 and the second cover securement means 40 respectively.

The longitudinal spacer member 42 is releasably secured between the first cover securement means 38 and the second cover securement means 40 by inserting the key assemblies 60 and 62 of the first spacer securement means 48 and the second spacer securement means 50 respectively in the corresponding slots 56 and 58 of the first cover securement means 38 and the second cover securement means 40 and then rotating the longitudinal spacer member 42 to, in turn, rotate the key assemblies 60 and 62 within the corresponding slots 56 and 58 until the key assemblies 60 and 62 are no longer aligned with the corresponding slots 56 and 58 thereby forming a connection therebetween. To remove the longitudinal spacer member 42 from between the first cover securement means 38 and the second cover securement means 40, the longitudinal spacer member 42 is again rotated to, in turn, rotate the key assemblies 60 and 62 within the corresponding slots 56 and 58 until the key assemblies 60 and 62 are again aligned with the corresponding slots 56 and 58 and then removing the key assemblies 60 and 62 from out of the corresponding slots 56 and 58.

In the preferred embodiment, the slots 56 and 58 of the first cover securement means 38 and the second cover securement means 40 are offset with respect to one another and the key assemblies 60 and 62 of the first spacer securement means 48 and the second spacer securement means 50 are likewise offset with respect to one another. The position of the key assemblies 60 end 62 with respect to the corresponding slots 56 and 58 can be viewed from the outside of a closed binder as can be seen in FIGS. 5*a–d* and 6*a–d*. FIGS. 5*a–d* show the alignment of the key assembly 60 with respect to the corresponding slot 56 as the longitudinal spacer member 42 is rotated while FIGS. 6*a–d* show the relative alignment of the key assembly 62 with respect to the corresponding slot 58 as the longitudinal spacer member 42 is rotated. It is advantageous to offset the first cover securement means 38 and the first spacer securement means 48 with respect to the second cover securement means 40 and the second spacer securement means 50, respectively, to allow for the release of the longitudinal spacer member 42 from the first cover member 24 without, at the same time, releasing the longitudinal spacer member 42 from the second cover member 26.

The releaseable spacing means 20 of the present invention thus provide a means for maintaining the first cover member 24 and the second cover member 26 of the binder 22 in a substantially spaced parallel relationship while also maintaining the first cover member 24 and the second cover member 26 in a closed position. The releaseable spacing means 20 thus allow for several binders 22 to be stacked or stood adjacent to one another without the undesired collapsing or sliding which has been known heretofore. The releasable spacing means 20 also provide means for standing a single binder 22 on a shelf.

The releasable spacing means 20 further allow for the use of the binders 22 in filing drawers where several binders 22 may be stood adjacent to one another on the spine members 28. The pocket 36 shown in FIG. 1 is beneficial for placement of file identification indicia when the binders 22 are stored in this manner. Adhesive labels (not shown) could be substituted for pocket 36. Alternatively, the binders 22 may be stood adjacent to one another on their spacer edges 63 and the file identification indicia may be placed on the spine members 28 (not shown). In addition, hangers (not shown) could be provided for hanging the binders 22 in a hanging file drawer (not shown).

Figure 7:
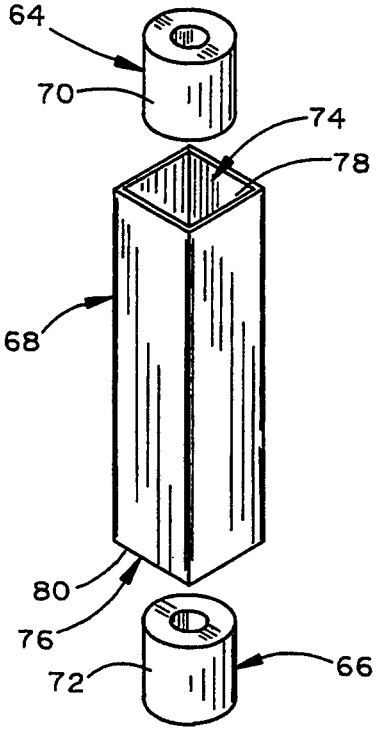
FIG. 7 is a perspective view of an alternative embodiment of the releasable spacing means of the present invention.
Figure 5B:
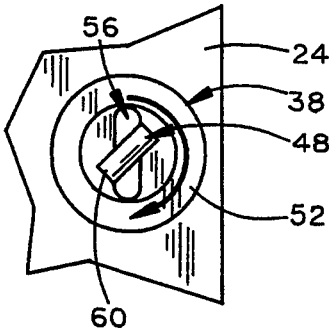
Figure 6B:
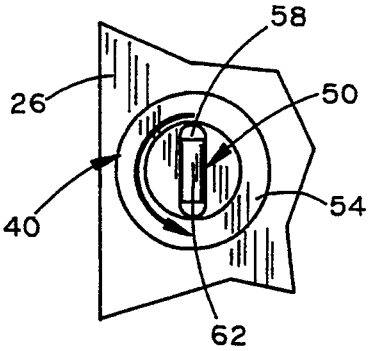
Figure 5C:
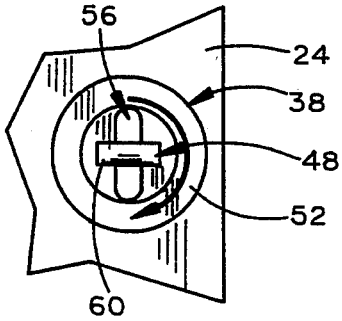
Figure 6C:
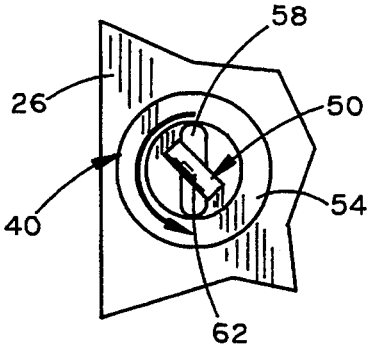

Alternative first cover securement means 64 and second cover securement means 66 and longitudinal spacer member 68 are shown in FIG. 7. The first cover securement means 64 and the second cover securement means 66 comprise raised substantially cylindrical members 70 and 72 respectively each having a substantially circular cross-section. The cylindrical members 70 and 72 correspond in location to receive the longitudinal spacer member 68 therebetween when the first cover member 24 and the second cover member 26 are in the closed position. The longitudinal spacer member 68 comprises a longitudinal four-sided hollow tube having a substantially square cross-section, the tube having inner dimensions which are slightly smaller than the diameter of the cylindrical members 70 and 72. First spacer securement means 74 and second spacer securement means 76 are comprised by the first open end 78 and the second open end 80 of the tube 68.

The longitudinal spacer member 68 of FIG. 7 is releasably secured between the first cover securement means 64 and the second cover securement means 66 by slipping the first open end 78 and the second open end 80 of the tube 68 over the first cylindrical member 70 and the second member 72 respectively thereby forming a biased connection therebetween. The longitudinal spacer member 68 is removed from the first cover securement means 64 and the second securement means 66 by pulling the first and second open ends 78 and 80 of the tube 68 away from the first and second cylindrical members 70 and 72 thereby overcoming the biased connection therebetween.

Figure 8:
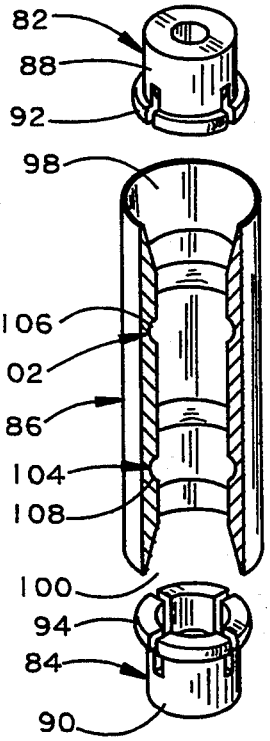
FIG. 8 is a perspective view of another alternative embodiment of the releasable spacing means of the present invention.
Figure 5D:
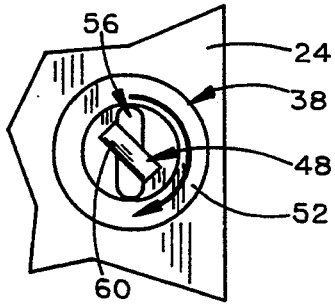
Figure 6D:
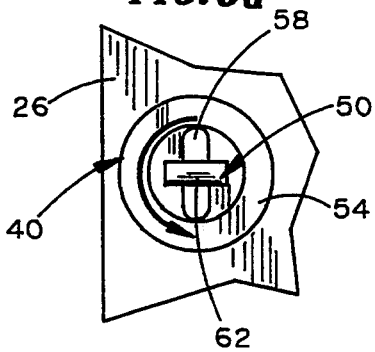
Figure 9:
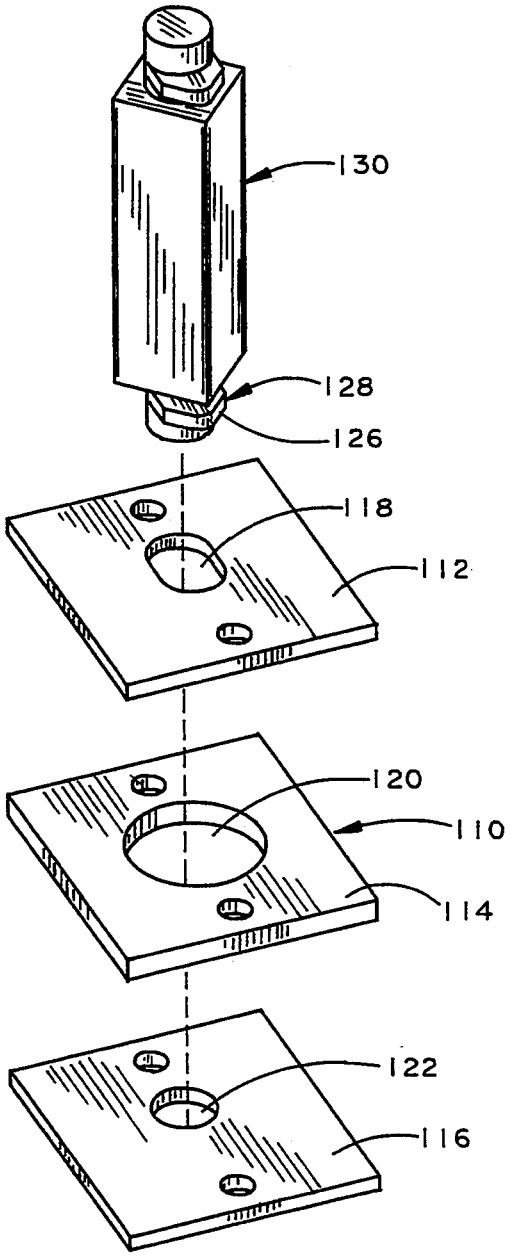
FIGS. 9–12 are perspective views of yet another alternative embodiment of the releaseable spacing means of the present invention.
Figure 10:
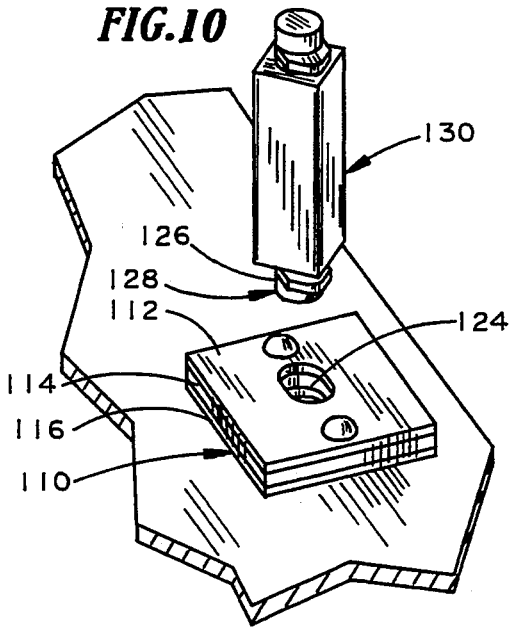
Figure 11:
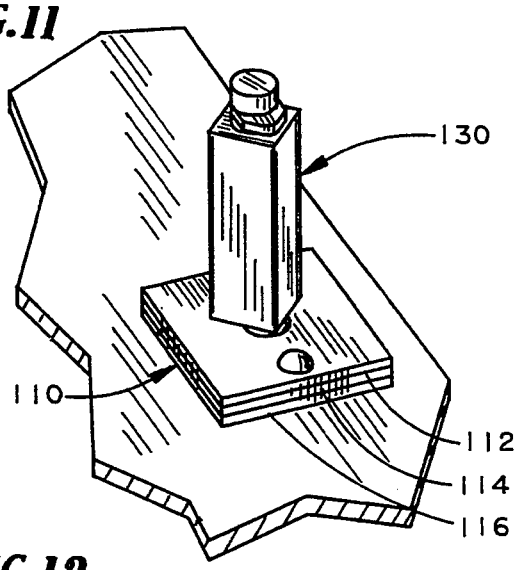
Figure 12:
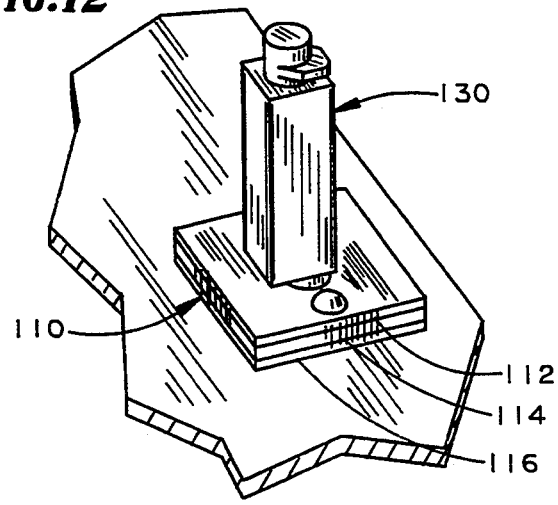
Figure 13:
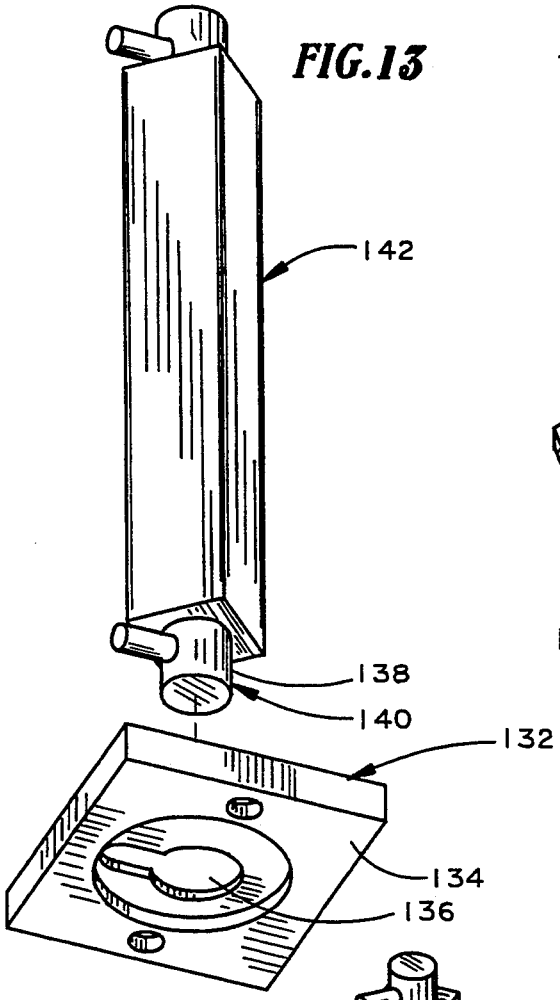
FIGS. 13–16 are perspective views of still another alternative embodiment of the releaseable spacing means of the present invention.
Figure 14:
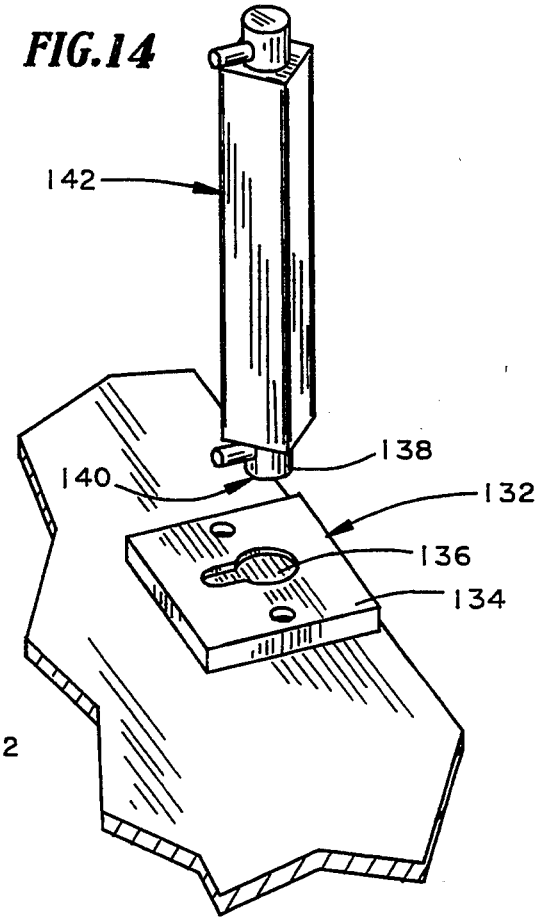
Figure 15:
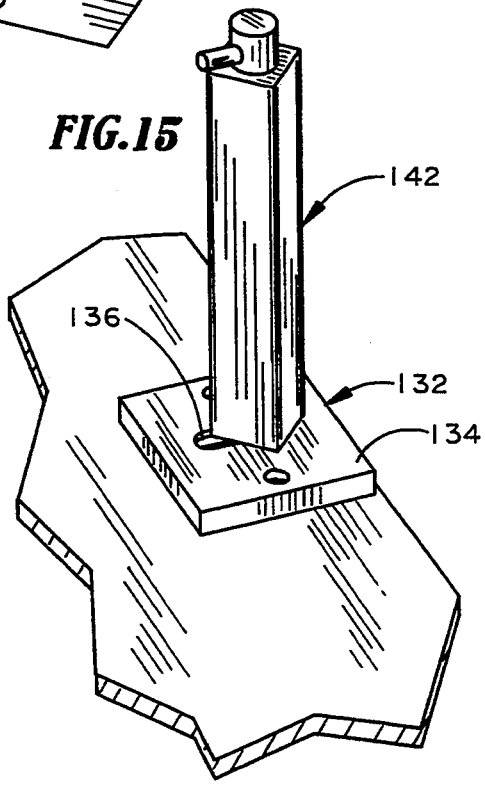
Figure 16:
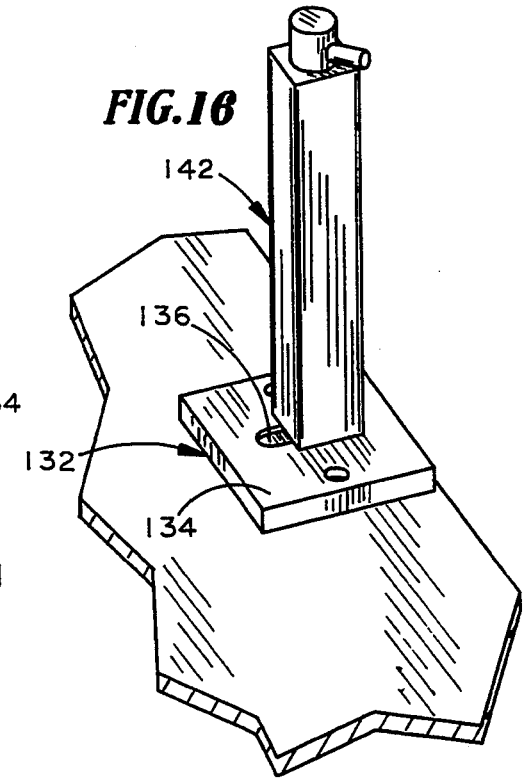

Another alternative embodiment is shown in FIG. 8. Here, first cover securement means 82 and second cover securement means 84 and longitudinal spacer member 86 are shown. The first cover securement means 82 and the second cover securement means 84 comprise raised substantially cylindrical members 88 and 90 each having a substantially circular cross-section. The cylindrical members 88 and 90 further comprise slotted lip members 92 and 94 respectively capable of varying diameter from a minimum diameter during compression to a maximum diameter during decompression. The cylindrical members 88 and 90 correspond in location to receive the longitudinal spacer member 86 therebetween when the first cover member 24 and the second cover member 26 are in the closed position. The longitudinal spacer member 86 comprises a substantially cylindrical hollow tube having a first open end 98 and a second open end 100. The longitudinal spacer member 86 has a substantially circular cross-section and an inner diameter which narrows from the open outer ends 98 and 100 to first spacer securement means 102 and second spacer securement means 104 respectively which comprise inner annular grooves 106 and 108 located proximate the narrowest inner diameters, respectively, of the tube 86. The inner annular grooves 106 and 108 have a diameter corresponding to the maximum diameter of the slotted lip members 92 and 94 of the first cover securement means 82 and the second cover securement means 84 respectively.

The longitudinal spacer member 86 of FIG. 8 is releasably secured between the first cover securement means 82 and the second cover securement means 84 by slipping the first open end 98 and the second open end 100 of the tube 86 over the first cylindrical member 88 and the second cylindrical member 90 respectively, the narrowing inner diameters of the tube 86 thereby compressing the slotted lip members 92 and 94 to accommodate the narrowing inner diameter of the tube 86 until the slotted lip members 92 and 94 reach the inner annular grooves 106 and 108 respectively where said lip members 92 and 94 decompress thereby forming a biased connection therebetween. The longitudinal spacer member 86 is removed from the first cover securement means 82 and the second cover securement means 84 by pulling the first and second open ends 98 and 100 of the tube 86 away from the first and second cylindrical members 88 and 90, respectively, thereby overcoming the biased connection therebetween.

Yet another alternative embodiment is shown in FIGS. 9–12 in which cover securement means 110 comprise stacked reinforcing members 112, 114 and 116 with unique apertures 118, 120 and 122, respectively, which form a slot arrangement 124 for receipt of a key assembly 126 comprising spacer securement means 128 of a longitudinal spacer member 130. This alternative embodiment functions in a similar manner to the preferred embodiment of FIGS. 1–6.

Still another alternative embodiment is shown in FIGS. 13–16 in which cover securement means 132 are comprised of a reinforcing member 134 having yet another slot configuration 136 for receipt of another key assembly 138 which comprises the spacer securement means 140 of a longitudinal spacer member 142. Again, this alternative embodiment functions in a similar manner to the preferred embodiment of FIGS. 1–6.

In addition, another alternative embodiment is anticipated in which the cover securement means and the spacer securement means comprise mated snap fasteners (not shown), the construction of which are well known.

The foregoing description and drawings merely explain and illustrate the invention and the invention is not limited thereto, except so far as the claims are so limited, as those skilled in the art who have the disclosure before them will be able to make modifications and variations therein without departing from the scope of the invention. For example, it is anticipated that the cover securement means and the spacer securement means could comprise a magnetic means of releasable attachment.

What is claimed is:

1. Releasable spacing means in combination with a binder, said binder having cover members, said releasable spacing means allowing for the spacing of said cover members in a substantially parallel relationship for even stacking and standing of several binders while maintaining said cover members in a closed position when said releasable spacing means are in place, said releasable spacing means comprising:

(a) first cover securement means located on and attached to a first cover member of said binder;

(b) second cover securement means located on and attached to a second cover member of said binder; and (c) a longitudinal spacer member having a first end and a second end for location between said first and second cover securement means, said spacer member further comprising first spacer securement means located on and integral with said first end of said spacer member for releasable attachment to said first cover securement means add second spacer securement means located on and integral with said second end of said spacer member for releasable attachment to said second cover securement means.

2. The combination of claim 1 in which said first spacer securement means are capable of mated alignment with said first cover securement means and said second spacer securement means are capable of mated alignment with said second cover securement means.

3. The combination of claim 2 in which mated alignment between said first spacer securement means and said first cover securement means is offset with respect to said mated alignment between said second spacer securement means and said second cover securement means.

4. The combination of claim 1 in which said first and second cover securement means each comprise a slot, said slots which correspond in location to receive said spacer member therebetween when said first and second cover members are placed in said closed position.

5. The combination of claim 4 in which said first and second spacer securement means each comprise a key assembly corresponding in size and shape to be received in said slots of said first and second cover securement means respectively.

6. The combination of claim 5 in which said key assemblies of said first and said spacer securement means are offset with respect to one another.

7. The combination of claim 5 wherein said key assemblies of said spacer securement means are rotatable into and out of alignment within said slots of said cover securement means thereby forming a releasable connection therebetween.

8. The combination of claim 4 in which said slots of said first and second cover securement means are offset with respect to one another.

9. The combination of claim 1 in which said spacer member comprises a longitudinal four-sided member of a length which, when releasably secured between said first and second cover securement means, spaces said first and second cover members in a substantially-parallel relationship.

10. The combination of claim 1 in which said first and second cover securement means each comprise a raised substantially cylindrical member having a substantially circular cross-section, said cylindrical members which correspond in location to receive said spacer member therebetween when said first and second cover members are in said closed position.

11. The combination of claim 10 in which said spacer member comprises a longitudinal four-sided hollow tube having a substantially square cross-section, said tube having inner dimensions which are slightly smaller than the diameter of said cylindrical members.

12. The combination of claim 11 in which said first and second spacer securement means comprise first and second open ends respectively of said tube.

13. The combination of claim 13 wherein said first and second open ends of said tube are capable of slipping over said first and second cylindrical members of said cover securement means thereby forming a releasable biased connection therebetween.

14. The combination of claim 1 in which said first and second cover securement means each comprise a raised substantially cylindrical member having a substantially circular cross-section, said raised cylindrical member further comprising a slotted lip member capable of varying diameter from a minimum diameter during compression to a maximum diameter during decompression, said raised cylindrical members which correspond in location to receive said spacer member therebetween when said first and second cover members are in said closed position.

15. The combination of claim 14 in which said spacer member comprises a longitudinal substantially cylindrical hollow tube having a first open end, a second open end, and a substantially circular cross-section, said substantially cylindrical hollow tube having a narrowing inner diameter from said first and second open ends, said inner diameter at its narrowest point corresponding to said minimum diameter of said slotted lip members of said first and second cover securement means.

16. The combination of claim 15 in which said first and second spacer securement means comprise inner annular grooves located proximate said narrowest inner diameters of said tube respectively, said inner annular grooves having a diameter corresponding to said maximum diameter of said slotted lip members of said first and second cover securement means.

17. The combination of claim 16 wherein said first and second open ends of said tube are capable of slipping over said cylindrical members of said cover securement means, thereby forming a releasable biased connection therebetween.

* * * * *